United States Patent [19]

Einarsson

[11] Patent Number: 4,528,775

[45] Date of Patent: Jul. 16, 1985

[54] SEALING MEANS FOR A DOOR LACKING A THRESHOLD

[75] Inventor: Stefan Einarsson, Lindome, Sweden

[73] Assignee: Ingemanssons Ingenjorsbyra AB, Gothenburg, Sweden

[21] Appl. No.: 552,329

[22] Filed: Nov. 16, 1983

[30] Foreign Application Priority Data

Nov. 29, 1982 [SE] Sweden ..... 8206792

[51] Int. Cl.[3] ..... E06B 7/20

[52] U.S. Cl. ..... 49/306; 49/308; 49/314

[58] Field of Search ..... 49/303, 307, 308, 306, 49/309, 310, 313, 314

[56] References Cited

U.S. PATENT DOCUMENTS 1,266,059 5/1918 Schnake ..... 49/307
2,095,668 10/1937 Kunkel ..... 49/314
3,281,990 11/1966 Nilsson ..... 49/306

FOREIGN PATENT DOCUMENTS 2815244 4/1978 Fed. Rep. of Germany ..... 49/310
3027679 7/1980 Fed. Rep. of Germany .

*Primary Examiner*—Kenneth Downey
*Attorney, Agent, or Firm*—Holman & Stern

[57] ABSTRACT

A sealing means for a door lacking a threshold comprises a lath of resilient material, which with a substantially plane main portion is attached to the lower edge of door leaf. A head, enlarged with respect to the main portion, is provided with sealing ridges and may be bent in relation to the attachment of the lath, so the ridges will be forced towards the floor. An actuating member, comprising a longitudinally compressible leaf spring, is fitted between the lower edge of the door leaf and the head of the lath, so it extends outside the vertical hinge edge of the door leaf. Just before the door reaches its closed position the leaf spring contacts the door frame, and will then force the portion of the head adjacent to the hinge edge downwards. During the terminal portion of the closing movement the friction between the floor and the downwardly turned portions of the ridges will "roll" the head to full contact with the floor.

10 Claims, 7 Drawing Figures

SEALING MEANS FOR A DOOR LACKING A THRESHOLD

BACKGROUND OF THE INVENTION

In many installations it is not possible to provide a threshold for a door, for instance where wheeled carriages, or wheel chairs have to pass. The sealing of the gap remaining between the door leaf and the floor causes definite problems as it, not only is a question of shutting off draft, but also to dampen noise, to seal against dust and so forth.

A known type of sealing means comprises a soft bead at the floor, extending across the door opening and one or more rubber lips at the lower edge of the door leaf, which, in closed position seal against the bead. A notable drawback of this design is that the bead will form a resistance to the passage of vehicles and the like, and that the arrangement will only permit small tolerances with respect to unevenness in the floor, and that it is difficult to make any adjustments.

There are also movable sealing devices at the lower edge of the door leaf, which may be brought into contact with the floor in various ways. These sealings are complicated and expensive, and many of them will require recessing into the door leaf, for instance so actuating members can be located in milled grooves. These devices are mostly sensible to unevenness of the floor, they are subjected to hard wear, and will require repeated survey and adjustments The aim of the present invention is to propose a simple and efficient sealing means for a door lacking a threshold, which does not require any recessing at the door leaf, and where the movements of the door leaf can be used as an essential source for activating the sealing.

SUMMARY OF THE INVENTION

The sealing thus comprises a lath of resilient material which is fitted along the bottom edge of the door leaf and is actuable during a closing movement of the door to be brought into contact with the floor. In known sealing means of this kind, which are actuated by some mechanism at the door leaf during the closing movement, the sealing member is simultaneously forced downwards all along the breadth of the door leaf, which causes considerable wear at the portion of the sealing member remotely located with respect to the hinge axis, and thus will slide along the floor a considerable distance. The arrangement further means a noticeable resistance during a closing or opening movement.

The invention is characterized in that the lath comprises a substantially plane main portion for attachment to the door leaf and a head being enlarged in relation to the main portion, that an acutating member mounted at the lower edge of the door leaf is adapted to force a portion of the lath head, adjacent to the hinge side of the door into contact with the floor, just when the door leaf approaches closed positon, and that the face of the head for contacting the floor is formed to permit a successive unrolling of the remainder of the head during the terminal portion of the closing movement.

The reverse side face of the lath turned away from the door leaf in unmounted state is preferably substantially flat and the thickness of the main portion may favourably increase towards the head, the end face of the head, turned away from the main portion being inclined with respect to the reverse side face of the lath, and with its longitudinal edge remote therefrom reaches past an imaginary extension of the inward contact face of the main portion. The end face of the head preferably comprises at least two longitudinally running ridges.

In order to facilitate a folding down of the head and the following rolling action, a channel shaped weakening is preferably provided in the lath between the head and the main portion at the contact face of the lath.

The lath is advantageously mounted in a moulding, which encloses the lath main portion and with a belled lip covers at least part of the outwardly turned end face of the head. The moulding may carry an additional sealing strip, adapted to support the head in its swung down position.

In order to minimize machining of the door leaf the actuating member may comprise a leaf spring, the end of which remote from the hinge side of the door leaf is adapted to co-operate with a stop at the door, and which in unbiased position, with its opposite end, projects outside the vertical hinge edge of the door leaf to be forced inwards by the door frame, during a closing of the door.

To provide the necessary movement of the actuating member at a suitable angular position of the door leaf during a closing operation a resilient contact body is preferably fitted at the door frame, and is adapted to co-operate with the projecting end of the spring leaf.

DESCRIPTION

Figure 1:
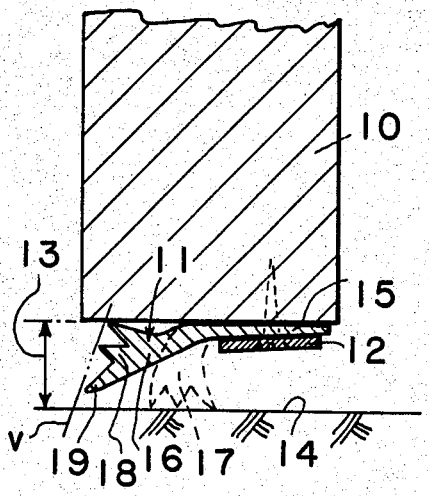
FIGS. 1 and 2 show two embodiments of a sealing means according to the invention, FIG. 3 on a larger scale shows a sealing lath and the member actuating the same.

FIG. 1 shows a vertical cross section through the lower portion of a door leaf 10, along the lower edge of which a sealing means according to the invention is fitted. The sealing means comprises a lath 11 of resilient material, which by a simple flat bar 12 may be attached to the door leaf, without any recessing thereof.

Normally there is a clearance 13 between the lower edge of the door and the floor 14, being about 10 to 20 mm, and it is this clearance that must be efficiently sealed when the door is closed.

The lath 11 includes a substantially plane main portion 15 merging into an enlarged head 16. The flat bar 12 has about the same breadth as the main portion, and the head 16 is foldable in relation to the attachment, so it can be brought into contact with the floor 14, as indicated by broken lines at 17.

The face of the head 16 to be turned towards the door substantially forms an extension of the corresponding face of the main portion, and its end face 18, turned away from the attachment, is obliquely cut and will, in unbiased position form an angle $>90°$ with the plane of the attachment. In the folded down position of the head this end face shall be substantially parallel to the floor.

At least two, preferably three longitudinal ridges 19 are formed in the end face, and will make possible a good contact with the floor, irrespective of possible unevenness thereof.

Figure 2:
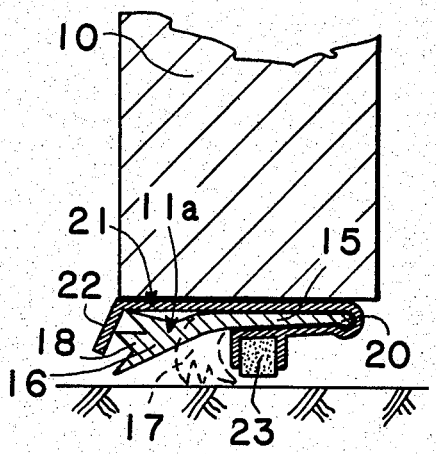

FIG. 2 shows a modified embodiment of the sealing means according to FIG. 1. The lath 11*a* is about the same as in the previous case, but the edge thereof remote from the head 16 is formed with a bead 20. The lath is mounted in a moulding 21 of metal plate or synthetic resin, which is adapted to be fitted at the door together with the lath.

The longitudinal edge of the moulding is bent downwards to form a belled lip 22 which, at least partly, covers the head 16. The moulding carries a further sealing 23, being a straight strip which, however, does not reach any contact with the floor. The intention is that it shall support the head 16 in its folded down position 17, and it will increase the sound dampening. This second strip may possibly be formed integral with the lath 11.

Figure 3:
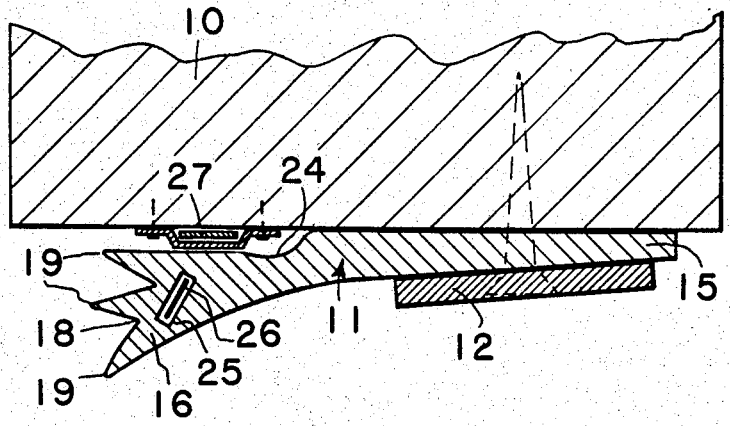
Figure 7:
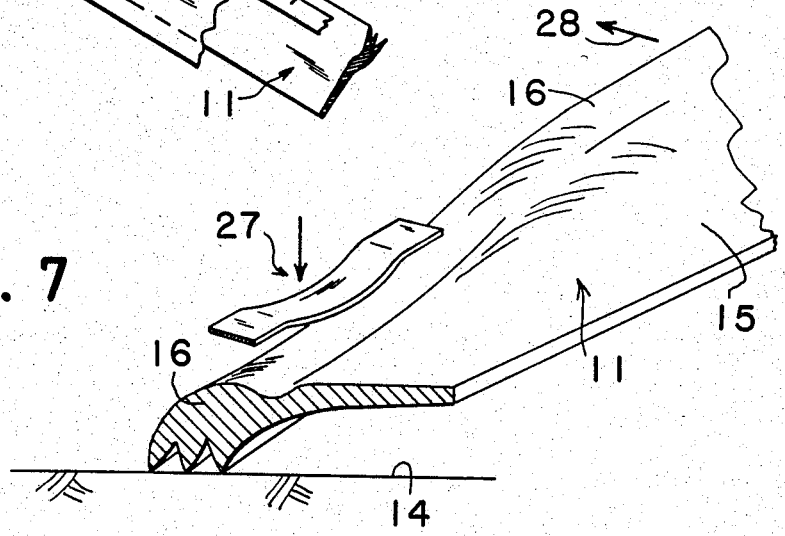

FIG. 3 shows the sealing means on a larger scale and indicates the actuating member. The function thereof will be better explained in conjunction to FIGS. 4 and 7. The lath 11 has basically the same shape as in FIG. 1, but is, in its face to be turned towards the door leaf, provided with a longitudinally running groove 24, forming a weakening of the structure and making it easier to fold the head downwards in relation to the main portion.

The head 16 is formed with a longitudinally running cavity 25, which is located substantially parallel to the ridged end face 18 of the head. Generally speaking this cavity will make it easier to fold the head downwards during the closing movement. In the portion of the lath adjacent to hinge side of the door a metal bar 26 is preferably inserted in the cavity 25 to make this portion more rigid for co-operation with the actuating mechanism 27, which during the closing movement of the door will force this portion of the head towards the floor.

Figure 4:
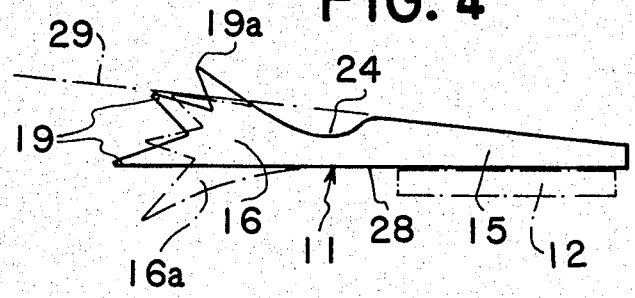
FIG. 4 shows a cross section of a preferred embodiment of the lath.

FIG. 4 shows a preferred embodiment of the lath 11. For manufacturing reasons the reverse face 28 thereof, turned away from the door, is preferably flat. The thickness of the main portion 15 increases in the direction towards the head, and between the main portion and the head, the groove 24 is located in the face of the lath to be turned towards the door.

The uppermost ridge 19*a* in the head will, in unstressed condition of the lath, reach above an imaginary extension line 29 of the inward face of the main portion. This imaginary line will in mounted position be substituted by the lower edge of the door leaf. When the lath 11 is mounted at the latter, the head 16 will be forced slightly downwards, as is indicated by broken lines at 16*a*. The lath will in this manner be subjected to a prestressing, ensuring that the head will not, by itself, sink down towards the floor.

The movement of the sealing means towards the floor must be initiated in some way. Due consideration must here be taken to two factors. To reduce manufacturing costs it is desirable to make as small recessing as possible in the door leaf, but furthermore the lath should not be forced to contact the floor all along its length immediately.

The shape of the lath makes it possible to force the head 16 towards the floor, locally adjacent to the hinge side of the door, just before the door reaches its closed position. When the pertinent parts of the ridges 19 are trailed along the floor the friction will automatically "roll" the head towards the sealing position. This is schematically illustrated FIG. 6, where the actuating member 27 has just forced the left hand portion of the lath 11 downwards, while the head 16 in the right hand portion of the lath shown still remains in its rest position, but is expected to be swung in the direction of the arrow 28.

Figure 5:
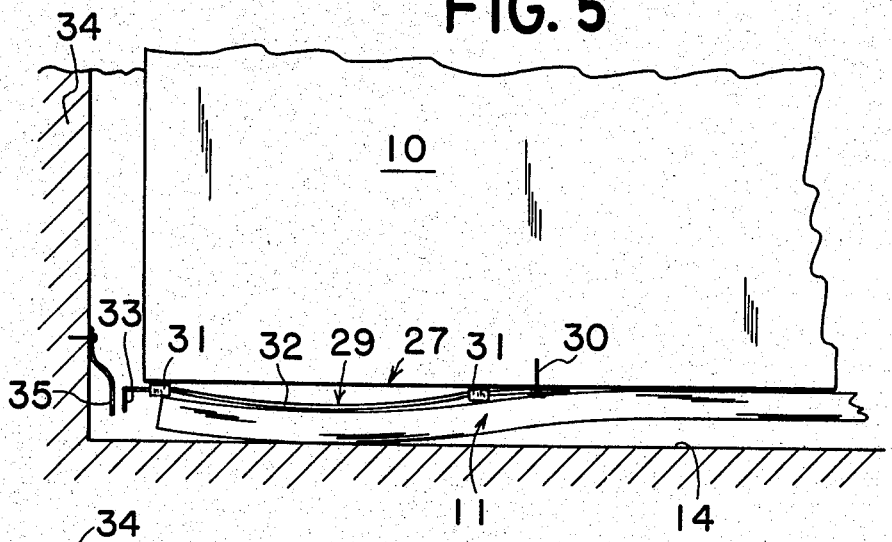
FIG. 5 shows an elevation of a portion of the hinge side of a door, and illustrating the working of the actuating mamber.
Figure 6:
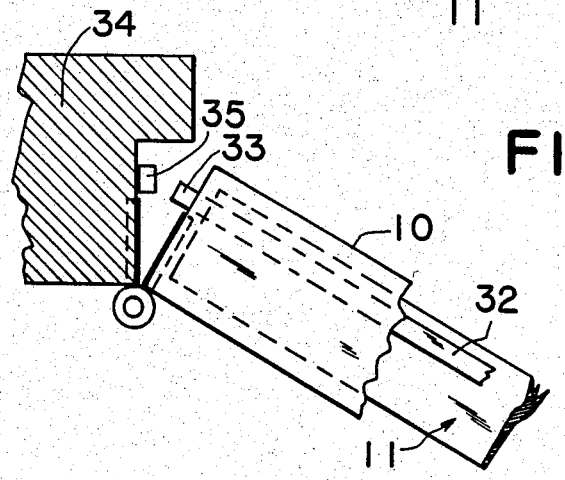
FIG. 6 shows a horizontal section through the portion of the door shown in FIG. 5, and FIG. 7 schematically illustrates how the actuating member causes the rolling-down movement of the lath.

The actuation upon the pertinent portion of the lath may be brought about in various ways, but in order to avoid recessing in the body of the door leaf a mechanism 27 of the type shown in FIGS. 5 and 6 is preferably used.

The mechanism includes a leaf spring 29, the end of which remote from the door's hinge side is fixedly located at the door leaf by means of a screw 30, or the like. The leaf spring 29 is carried by a holding fixture 31 in such a manner that a middle portion 32 of the spring will obtain a certain freedom of movement in the vertical direction, Instead of a fixed attachment of the leaf spring end it is possible to use a resilient stop member. This may be adapted to co-operate in the flexing of the leaf spring, and will ensure a retraction thereof.

The end 33 of the leaf spring remote from the attachment 30 projects outside the vertical inner edge of the door leaf, and is bent a distance therefrom, or is in some other way provided with a suitable abutment body.

At a certain position during the closing movement of the door the bent end portion 33 of the leaf spring will obtain contact with the door frame 34, whereupon the leaf spring 29 will be forced inwards. As the inward end of the spring is fixed the middle portion 32 of the spring will belly-out downwards, and will then force the underlying portion of the head 16 downwards.

The total length of the leaf spring, as well as of the projecting portion 33 thereof, will have to be selected with respect to the desired depressing movement. This must be initiated while the door leaf is still somewhat away from its fully closed position. If it is not acceptable to have a marked projecting portion 33 of the leaf spring it is possible to provide a resilient contact body 35 in the door frame 34, which at the appropriate moment pushes the leaf spring 29 inwards, and is then finally itself compressed when the door is fully closed.

The contact body is shown as a simple bent leaf spring, but may be formed in different ways. It may for instance include a spring biased piston, which is slidable in a bore in the door frame.

Basically the actuating member could include a projection in the floor, adjacent to the hinge side, which during a closing operation catches the lowermost ridge 19, and swings the portion of the head 16 adjacent to the hinge side downwards.

Further modifications of the components shown are possible within the scope of the appended claims.

What I claim is:

1. A sealing means for a door comprising a leaf hinged about one vertical edge in a frame lacking any threshold at the floor and comprising a lath of resilient material having a contact face and a reverse face and including a substantially plane main portion for attachment to the lower edge of said door leaf and a head being enlarged in relation to said main portion, an actuating member mounted at said lower edge and adapted to force a portion of said lath head, adjacent to the hinge edge of said door leaf, into contact with the floor, just when the door leaf approaches closed position, the end face of said head for contacting the floor unbiased by said actuating member forming an angle >90° with the lower edge of said door leaf, and presenting a lower edge adjacent to said floor, facilitating a successive unrolling of the head during a terminal portion of a closing movement.

2. A sealing means according to claim 1, in which the reverse side face of said lath turned away from the door leaf, in unmounted state is substantially flat, the thickness of said main portion increasing towards the head, the end face thereof, turned away from said main portion being inclined with respect to said reverse side face of the lath, and with its longitudinal edge remote therefrom reaching past an imaginary extension of the inward contact face of the main portion.

3. A sealing means according to claim 2, in which said end face of the head comprises at least two longitudinally running ridges.

4. A sealing means according to claim 2, in which a channel shaped weakening is provided in said lath between the head and the main portion, at the contact face of the lath.

5. A sealing means according to claim 2, further including a cavity located within said head, and extending along said lath.

6. A sealing means according to claim 5, in which said cavity has a slot-shaped cross section, and runs substantially parallel to the ridged end face of said head.

7. A sealing means according to claim 1, in which said lath is mounted in a moulding, which encloses the main portion of said lath and with a belled lip covers at least part of the outwardly turned end face of said head.

8. A sealing means according to claim 7, in which said moulding carries an additional sealing strip adapted to support said head in its swung down position.

9. A sealing means according to claim 1, in which said actuating member comprises a leaf spring, the end of which remote from the hinge edge of said door leaf is adapted to co-operate with a stop at the door, and which in unbiased position, with its opposite end, projects outside the vertical hinge edge of the door leaf to be forced inwards by the door frame, during a closing of the door.

10. A sealing means according to claim 9, further including a resilient contact body, fitted at said door frame, and adapted to co-operate with the projecting end of said spring leaf.

* * * * *